United States Patent [19]

Geiser

[11] 3,979,309

[45] Sept. 7, 1976

[54] LUBRICATING OIL ADDITIVE

[75] Inventor: Edward M. Geiser, Downers Grove, Ill.

[73] Assignee: UOP Inc., Des Plaines, Ill.

[22] Filed: Aug. 14, 1975

[21] Appl. No.: 604,756

[52] U.S. Cl. ..... 252/32.5; 44/58; 44/71; 252/52 R

[51] Int. Cl.[2] ..... C10L 1/10; C10L 1/22; C10M 1/44; C10M 3/38

[58] Field of Search ..... 44/58, 71; 252/32.5, 252/52 R

[56] References Cited

UNITED STATES PATENTS

| | | | |
|---|---|---|---|
| 3,316,175 | 4/1967 | Latos et al. | 252/32.5 |
| 3,499,923 | 3/1970 | Cyba | 252/32.5 |
| 3,502,677 | 3/1970 | Le Suer | 252/32.5 |
| 3,542,679 | 11/1970 | Cyba | 252/32.5 |

*Primary Examiner*—Delbert E. Gantz
*Assistant Examiner*—I. Vaughn
*Attorney, Agent, or Firm*—James R. Hoatson, Jr.; William H. Page, II; Raymond H. Nelson

[57] ABSTRACT

Additives which are useful in lubricating oils, and particularly in two-cycle engine lubricating oils, comprise an admixture of a major amount of the salt of two equivalents of an N-alkyldiaminoalkane with one equivalent of a dimer dicarboxylic acid and one equivalent of an alkyl acid phosphate, a minor amount of an alkylated hydroxytoluene, and a paraffin oil vehicle.

9 Claims, No Drawings

LUBRICATING OIL ADDITIVE

This invention relates to novel additives for use in lubricating oils. More specifically, the invention is concerned with an additive for use in two-cycle engines.

Two-cycle engines require an admixture of the fuel such as gasoline and a lubricating oil in order to be operated. It has now been discovered that an additive may be admixed with the lubricating oil which will provide improved lubricity, anti-wear properties, and corrosion inhibition. In addition, the additive of the type hereinafter set forth in greater detail is thermally stable to high temperature operation and will exhibit exceptional resistance to hydrolytic degradation. Thus, by utilizing the additive of the present invention it is possible to operate the two-cycle engine under relatively severe conditions of temperature and, in addition, the parts of the two-cycle engine which may be subject to rust when oil drains from the upper cylinder or chamber walls or is replaced by condensed moisture will be protected therefrom.

It is therefore an object of this invention to provide an additive which is useful in lubricating oils.

A further object of this invention is to provide an additive for use in lubricating oils which are utilized in admixture with a fuel, the resulting admixture being used in two-cycle engines.

In one aspect an embodiment of this invention resides in an additive for a lubricating oil which comprises an admixture of the salt of two equivalents of an N-alkylpolyamine with one equivalent of a dimer acid and one equivalent of an alkyl acid phosphate, an alkylated hydroxytoluene and paraffin oil.

Another embodiment of this invention is found in a lubricating oil for a two-cycle engine which comprises a blend of a neutral oil, bright stock, solvent and additive.

A specific embodiment of this invention is found in an additive for a lubricating oil which comprises an admixture of a salt of two equivalents of N-tallow-1,3-propanediamine with one equivalent of a dimer acid and one equivalent of monodiisooctyl acid orthophosphate, 2,6-di-t-butyl-p-cresol and paraffin oil.

Another specific embodiment of this invention is found in a lubricating oil which comprises about 55 to about 65% by volume of a neutral oil, from about 7 to about 12% by volume of a bright stock, from about 12 to about 20% by volume of a solvent and from about 7 to about 20% by volume of an additive which comprises an admixture of a salt of two equivalents of N-tallow-1,3-propanediamine with one equivalent of a dimer acid and one equivalent of monodiisooctyl acid orthophosphate, 2,6-di-t-butyl-p-cresol and paraffin oil.

Other objects and embodiments will be found in the following further detailed description of the present invention.

As hereinbefore set forth, the present invention is concerned with an additive for a lubricating oil, and especially an additive for a lubricating oil which is used in a two-cycle engine. The lubricating oil containing the additive can be readily admixed with fuel for the two-cycle engine such as regular grade gasoline, leaded gasoline, etc., in a ratio of from about 50:1 to about 200:1 parts of gasoline to lubricating oil. The resulting admixture will provide improved wear properties, lubricity, and corrosion inhibition to the two-cycle engine during the operation of said engine.

The additive which is utilized will consist of from about 35 to about 45% by weight of the salt of two equivalents of an N-alkylpolyamine with one equivalent of a dimer acid and one equivalent of an alkyl acid phosphate, from about 0.5% to about 1.5% by weight of an alkylated hydroxytoluene and from about 54.5% to about 64.5% by weight of a paraffin oil. Examples of N-alkylpolyamines which may be utilized as one component of the salt will include those compounds in which the alkyl moiety will contain from about 3 to about 30 carbon atoms and more particularly from about 6 to about 20 carbon atoms while the alkane portion will contain from about 2 to about 12 carbon atoms and preferably from 3 to about 6 carbon atoms. The preferred compounds will comprise N-alkyldiaminoalkanes. A particularly preferred N-alkyldiaminoalkane is N-alkyl-1,3-diaminopropane, the alkyl group being derived from tallow. This compound is available commercially under the tradename of "Duomeen T". Other preferred N-alkyl-1,3-diaminopropanes comprise those in which the alkyl group is derived from lauric acid, coconut fatty acid, soya fatty acid, etc. These are available commercially at the present time and comprise mixed alkyl-substituted 1,3-diaminopropanes. For example, in the case of "Duomeen T" the alkyl groups contain from 12 to about 20 carbon atoms per group and mostly contain 16 to 18 carbon atoms. However, when desired, the alkyl group of the N-alkyl-1,3-diaminopropane or other N-alkyldiaminoalkanes may be prepared to contain any number of carbon atoms desired in the alkyl group and, thus, may be selected from hexyl, heptyl, octyl, nonyl, decyl, undecyl, dodecyl, tridecyl, tetradecyl, pentadecyl, hexadecyl, heptadecyl, octadecyl, nonadecyl, eicosyl, etc. It is understood that a mixture of diamines containing different alkyl groups may be employed and that the alkyl and alkane moieties may be of straight or branched chain. Furthermore, it is understood that the alkyl moiety may be of primary, secondary or tertiary configuration. Also, particularly preferred in this embodiment are the beta amines in which the alkyl group is attached to the nitrogen atom through the beta carbon atom of the alkyl group.

While the N-alkyl-1,3-diaminopropanes are preferred, it is understood that other suitable N-alkyldiaminoalkanes may be employed. Illustrative examples include N-alkyl-1,2-diaminoethanes, N-alkyl-1,2-diaminopropanes, N-alkyl-1,2-diaminobutanes, N-alkyl-1,3-diaminobutanes, N-alkyl-1,4-diaminobutanes, N-alkyl-1,2-diaminopentanes, N-alkyl-1,3-diaminopentanes, N-alkyl-1,4-diaminopentanes. N-alkyl-1,5-diaminopentanes, N-alkyl-1,2-diaminohexanes, N-alkyl-1,3-diaminohexanes, N-alkyl-1,4-diaminohexanes, N-alkyl-1,4-diaminohexanes, N-alkyl-1,6-diaminohexanes, etc.

The second component of the salt which is prepared by admixing two equivalents of the aforesaid N-alkylpolyaminoalkanes with one equivalent of a dimer acid and one equivalent of an alkyl acid phosphate comprises the aforesaid dimer acids. The dimer acids may be characterized as dimeric carboxylic acids which may possess molecular weights above about 300. Any suitable dicarboxylic acid may be used and will contain from 10 to about 50, and preferably from 20 to 40 carbon atoms per molecule. A number of dicarboxylic acids are available commercially, generally as a mixed byproduct and accordingly marketed at a lower cost. One such dicarboxylic acid is marketed under the tradename of "VR-1 Acid". This acid is a mixture of polybasic acids, predominantly dicarboxylic acids, and has an average molecular weight of about 750. Another mixed byproduct acid is marketed commercially under the tradename of "Dimer Acid". Still another such acid is marketed under the tradename of "D-50-MEX" acid.

Still another mixed byproduct acid is marketed commercially under the tradename of "Empol 222". This dimer acid is a dilinoleic acid and is a viscous liquid having an apparent molecular weight of approximately 600. It has an acid value of 180–192, an iodine value of 80–95, a saponification value of 185–195, a neutralization equivalent of 290–310, a refractive index at 25° C. of 1.4919, a specific gravity at 15.5° C./15.5° C. of 0.95, a flash point of 530° F., a fire point of 600° F., and a viscosity at 100° C. of 100 centistokes.

Other dicarboxylic acids include alkyl dicarboxylic acids in which the alkyl contains at least 10 carbon atoms per molecule and thus may comprise alkyl malonic acid, alkyl succinic acid, alkyl glutaric acid, alkyl adipic acid, alkyl pimelic acid, alkyl suberic acid, alkyl azelaic acid, alkyl sebacic acid, alkyl phthalic acid, and higher molecular weight dicarboxylic acids, as well as mixtures of said acids. It is to be understood that the aforementioned dicarboxylic acids are only representative of the type of dimer acids which may be employed, and that the present invention is not necessarily limited thereto.

The third component of the salt comprises an alkyl acid phosphate. Illustrative examples of the preferred alkyl acid phosphates comprise those compounds in which the alkyl moiety contains from 3 to about 20 carbon atoms, and more particularly from about 4 to about 15 carbon atoms each. Accordingly, particularly preferred alkyl acid orthophosphates include monobutyl acid orthophosphate, dibutyl acid orthophosphate, a mixture of mono- and dibutyl acid orthophosphates, monopentyl acid orthophosphate, dipentyl acid orthophosphate, a mixture of mono- and dipentyl acid orthophosphates, monohexyl acid orthophosphate, dihexyl acid orthophosphate, a mixture of mono- and dihexyl acid orthophosphates, monoheptyl acid orthophosphate, diheptyl acid orthophosphate, a mixture of mono- and diheptyl acid orthophosphates, monooctyl acid orthophosphate, dioctyl acid orthophosphate, a mixture of mono- and dioctyl acid orthophosphates, monononyl acid orthophosphate dinonyl acid orthophosphate, a mixture of mono- and dinonyl acid orthophosphates, monodecyl acid orthophosphate, didecyl acid orthophosphate, a mixture of mono- and didecyl acid orthophosphates, monoundecyl acid orthophosphate, diundecyl acid orthophosphate, a mixture of mono- and diundecyl acid orthophosphates, monododecyl acid orthophosphate, didodecyl acid orthophosphate, a mixture of mono- and didodecyl acid orthophosphates, monotridecyl acid orthophosphate, ditridecyl acid orthophosphate, a mixture of mono- and ditridecyl acid orthophosphates, monotetradecyl acid orthophosphate, ditetradecyl acid orthophosphate, a mixture of mono- and ditetradecyl acid orthophosphates, monopentadecyl acid orthophosphate, dipentadecyl acid orthophosphate, etc. It is understood that the alkyl moiety may be of straight or branched chain and that it may be of primary, secondary or tertiary configuration.

Preferred alkyl acid pyrophosphates include monobutyl acid pyrophosphate, dibutyl acid pyrophosphate, mixture of mono- and dibutyl acid pyrophosphates, monopentyl acid pyrophosphate, dipentyl acid pyrophosphate, mixture of mono- and dipentyl acid pyrophosphates, monohexyl acid pyrophosphate, dihexyl acid pyrophosphate, mixture of mono- and dihexyl acid pyrophosphates, monoheptyl acid pyrophosphate, diheptyl acid pyrophosphate, mixture of mono- and diheptyl acid pyrophosphates, monooctyl acid pyrophosphate, dioctyl acid pyrophosphate, mixture of mono- and dioctyl acid pyrophosphates, monononyl acid pyrophosphate, dinonyl acid pyrophosphate, mixture of mono- and dinonyl acid pyrophosphates, monodecyl acid pyrophosphate, didecyl acid pyrophosphate, mixture of mono- and didecyl acid pyrophosphates, monoundecyl acid pyrophosphate, diundecyl acid pyrophosphate, mixture of mono- and diundecyl acid pyrophosphates, monododecyl acid pyrophosphate, didodecyl acid pyrophosphate, mixture of mono- and didodecyl acid pyrophosphates, monotridecyl acid pyrophosphate, ditridecyl acid pyrophosphate, mixture of mono- and ditridecyl acid pyrophosphates, monotetradecyl acid pyrophosphate, ditetradecyl acid pyrophosphate, mixture of mono- and ditetradecyl acid pyrophoshates, monopentadecyl acid pyrophosphate, dipentadecyl acid pyrophosphate, mixture of mono- and dipentadecyl acid pyrophosphates, etc. Here again, it is understood that the alkyl moiety may be of straight or branched chain and may be of primary, secondary or tertiary configuration.

The second component of the additive will comprise an alkylated hydroxytoluene in which the alkyl moiety of the compound will contain from 1 to about 6 carbon atoms. Some representative examples of these compounds will include 2-methyl-p-cresol, 2,6-dimethyl-p-cresol, 2-ethyl-p-cresol, 2,6-diethyl-p-cresol, 2-propyl-p-cresol, 2,6-dipropyl-p-cresol, 2-isopropyl-p-cresol, 2,6-diisopropyl-p-cresol, 2-n-butyl-p-cresol, 2,6-di-n-butyl-p-cresol, 2-t-butyl-p-cresol, 2,6-di-t-butyl-p-cresol, 2-n-pentyl-p-cresol, 2,6-di-n-pentyl-p-cresol, 2-sec-pentyl-p-cresol, 2,6-di-sec-pentyl-p-cresol, 2-n-hexyl-p-cresol, 2,6-di-n-hexyl-p-cresol, 2-sec-hexyl-p-cresol, 2,6-di-sec-hexyl-p-cresol. It is to be understood that the aforementioned alkylated hydroxytoluenes are only representative of the class of compounds which may be used and that the present invention is not necessarily limited thereto.

The third component of the additive comprises a paraffin oil. This paraffin oil will comprise all the paraffinic oils possessing a Saybolt Universal Second Value of 110 to a Saybolt Universal Second Value of 90 as measured at 100° F. by ASTM Test No. D-88. As a representative example of this type of oil, a paraffin oil which is marketed by the Shell Oil Company under the brand name Shell Carnea Oil 21 which has the following characteristics may be employed.

| | |
|---|---|
| Gravity, °API | 25.0 |
| Color, ASTM | L 1.5 |
| Pour Point, ° F. | −30 |
| Flash, COC ° F. | 330 |
| Fire, ° F. | 360 |
| Viscosity, SSU at 100° F. (I) | 96.3 |
| Viscosity, SSU at 210° F. | 38.0 |
| Viscosity Index | 43 |
| Carbon Residue % W. Ramsbottom | 0.09 |
| Neutralization Value TAN-C | LT 0.05 |
| Sulfur, % W. | 1.0 |
| Cu. Corrosion at 212° F. | Negative |

-continued

| | |
|---|---|
| Saponification No. | 0.7 |

(1) Control Viscosity

The salt of two equivalents of an N-alkylpolyaminoalkane with one equivalent of a dimer acid and one equivalent of an alkyl acid phosphate may be prepared in any suitable manner and in general are prepared by admixing the phosphate, the acid and the alkylpolyaminoalkane in appropriate proportions at ambient temperature and atmospheric pressure, preferably accompanied by vigorous stirring. While the salts are readily prepared at room temperature, slightly elevated temperatures which generally do not exceed about 90° C. may be employed if so desired. It is preferred to avoid excessive temperatures in order to prevent the undesired formation of reaction products resulting in the liberation of water and in the formation of phosphor amidic acid derivatives or other undesired reaction products. In addition, if so desired, it may be advantageous to utilize a solvent, either in forming a more fluid mixture of the phosphate and/or amines before mixing or during the mixing thereof. In some cases, it may also be desirable to admix the salt with a solvent in order to form a more fluid final product. Any suitable solvent may be used and generally will comprise an organic compound and more particularly a hydrocarbon distillate. Particularly preferred solvents will include aromatic hydrocarbons such as benzene, toluene, xylene, ethylbenzene, cumene, etc., or mixtures thereof, or paraffinic hydrocarbons including pentane, hexane, heptane, octane, nonane, decane, etc. After preparation of the desired salt of the type hereinbefore set forth, the solvent is removed by conventional means and it is then admixed in the proper weight percentages with the aforementioned alkylated hydroxytoluene and paraffin oil to form the desired additive.

The thus prepared additive is then formulated with the proper blend of neutral oils, bright stock, and solvents in appropriate proportions to prepare the desired two-cycle engine oil. As hereinbefore set forth, the two-cycle engine lubricating oil will contain from about 55 to about 65% by volume of a neutral oil, from about 7 to about 12% by volume of a bright stock, from about 12 to about 20% by volume of a solvent and from about 7 to about 20% by volume of the aforementioned additive. It is to be understood that any applicable neutral oil may be used as the major portion of the lubricating oil. An illustrative example of the type of neutral oil which may be employed is marketed by Cities Services Oil Company and possesses the following specifications:

| | |
|---|---|
| Gravity, ° API (1) | 29.5 |
| Flash Point, ° F.Min. | 510 |
| Fire Point, ° F.Min. | 570 |
| Viscosity, SUS at 100° F. | 670 |
| Viscosity, SUS at 130° F. (1) | 280 |
| Viscosity, SUS at 210° F. | 70–74 |
| Viscosity Index | 95 min. |
| Pour Point, ° F. Max. | 5 |
| Color, ASTM D1500 Max. | 2.0 |
| Carbon Residue, % Max. | 0.05 |
| Ash, Max. | Nil |
| Aniline Point, ° F. (1) | 246 |
| Neutralization No., Max. | 0.05 |
| Sulfur, % (1) | 0.25 |

-continued

| | |
|---|---|
| Pounds per Gallon (1) | 7.318 |

(1) Approximate — for information only

The second component of the lubricating oil will comprise, as hereinbefore set forth, from about 7 to about 12% by volume of a bright stock. An illustrative example of this bright stock which may be employed is also marketed by Cities Services Oil Company and has the following specifications:

| | |
|---|---|
| Gravity, ° API (1) | 26.5 |
| Flash Point, ° F. Min. | 580 |
| Fire Point, ° F. Min. | 630 |
| Viscosity, SUS at 100° F. | 2650 |
| Viscosity, SUS at 130° F. (1) | 950 |
| Viscosity, SUS at 210° F. | 150–160 |
| Viscosity Index | 95 min. |
| Pour Point, ° F. Max. | 5 |
| Color, ASTM D1500 Max. | 6.0 |
| Carbon Residue, % Max. | 0.40 |
| Ash, Max. | Nil |
| Aniline Point, ° F. (1) | 263 |
| Neutralization No., Max. | 0.05 |
| Sulfur, % (1) | 0.30 |
| Pounds per Gallon (1) | 7.457 |

(1) Approximate — for information only

It is contemplated within the scope of this invention that the third component of the lubricating oil comprises a solvent. In particular, petroleum naphtha solvents including light naphthas, mineral spirits, petroleum ethers, etc., may be employed. As an example of the type of solvents which may be used, a solvent known in the trade as Stoddard solvent which possesses the following specifications may be used.

| | |
|---|---|
| API Gravity, 60/60° F. | 52.8 |
| Specific Gravity 60/60° F. | 0.767 |
| Coefficient of Expansion per ° C. | 0.0009 |
| Δ Spec. Gravity per °C/°C. | .00055 |
| Refractive Index at 20° C. | 1.4190 |
| Distillation Range at 760 mm Hg | |
| ° C. | 156–193 |
| ° F. | 313–384 |
| Reid-Vap Press. at 100° F. PSI | 0.3 |
| Aniline Point °F. — Straight | 145 |
| Viscosity cps at 77° F. | 0.84 |
| Flash Point Tag C.C. ° F. | 105 |

The resulting lubricating oil comprising a blend of the aforementioned four components will provide an oil which is effective in the prevention of boundary conditions, will substantially reduce the coefficient of friction and will also be active in the inhibition of corrosion. In addition, the oil will also exhibit excellent thermal stability properties as well as being exceptionally resistant to hydrolytic degradation.

The following examples are given for purposes of illustrating the generally broad scope of the present invention. However, these examples are not intended to limit the generally broad scope of the present invention in strict accordance therewith.

EXAMPLE I

The desired salt which comprises one component of the additive is prepared by admixing two equivalents of a hydrogenated N-tallow-1,3-diaminopropane with one equivalent of the dimer acid sold commercially as VR-1 by Rohm & Haas Company and one equivalent of monoisobutyl acid orthophosphate, said reactants being thoroughly admixed at room temperature to form the desired salt. Following this, the salt is then admixed with 2,6-di-t-butyl-p-cresol and paraffin oil in such an amount so that the final composition of the additive consists of 39 wt. % of the salt, 1 wt. % of the 2,6-di-t-butyl-p-cresol and 60 wt. % of the paraffin oil.

A two-cycle engine lubricating oil which is representative of the oil of the present invention is then prepared by blending 60% by volume of neutral oil, 10% by volume of bright stock, 20% by volume of Stoddard solvent and 10% of the additive which is prepared according to the above paragraph. When the lubricating oil containing the additive of the present invention is tested with a laboratory pin and disc apparatus, it will be shown that the coefficient of friction of the Babbit-1045 steel bearing system which is operating under oil-starved conditions is reduced from 0.14 when lubricated with an oil which does not contain the additive to 0.06 when lubricated with the oil set forth in the above paragraph. In addition, it will also be found that the lubricating oil of the present invention is active at temperatures in excess of 150° C. thereby allowing a safe operating of a bearing journal system under more severe conditions than is possible when operating the system utilizing a lubricating oil which does not contain the additive. Other tests will indicate that there is a substantial reduction in the frictional torque of a bearing journal in a friction pendulum apparatus when utilizing the lubricating oil of the present invention and, in addition, the additive is also an effective wear-in agent thereby permitting a more accurate fitting of the bearing journal. In addition to the lubricating properties of the oil, it will also be found that the oil containing the additive of the present invention will be an effective rust inhibitor for a wide variety of metal surfaces, particularly iron or steel, the additive acting to preferentially wet the metal surface, displacing moisture and thereby forming a protective barrier against oxidation of the surface.

EXAMPLE II

In like manner a two-cycle engine oil additive is prepared by admixing 40% by weight of a salt which is prepared by intimately admixing two equivalents of N-coco-1,3-diaminopropane with one equivalent of a dimer acid marketed by the W. C. Hardesty Company under the tradename D-50-ME and one equivalent of monodiisobutyl acid orthophosphate, 1 wt. % of 2,6-di-t-butyl-p-cresol and 59% by weight of a paraffin oil. When a two-cycle engine lubricating oil consisting of 60% by volume of a neutral oil, 10% by volume of bright stock, 20% by volume of Stoddard solvent and 10% by volume of the additive hereinbefore set forth in this example is subjected to tests similar in nature to those described in Example I, similar results will be observed.

I claim as my invention:

1. An additive for a lubricating oil which comprises an admixture of a major amount of the salt of two equivalents of an N-alkyldiaminoalkane with one equivalent of a dimer dicarboxylic acid and one equivalent of an alkyl acid phosphate, a minor amount of an alkylated hydroxytoluene, and a paraffin oil vehicle.

2. The additive as set forth in claim 1 in which said salt is present in said admixture in a range of from about 35 to about 45% by weight, said alkylated hydroxytoluene is present in an amount in the range of from about 0.5% to about 1.5% by weight and said paraffin oil is present in an amount in the range of from about 54.5% to about 64.5% by weight.

3. The additive as set forth in claim 1 in which said N-alkyldiaminoalkane is N-tallow-1,3-propanediamine.

4. The additive as set forth in claim 1 in which said N-alkyldiaminoalkane is N-coco-1,3-propanediamine.

5. The additive as set forth in claim 1 in which said alkyl acid phosphate is monodiisobutyl acid orthophosphate.

6. The additive as set forth in claim 1 in which said alkyl acid phosphate is monodiisooctyl acid orthophosphate.

7. The additive as set forth in claim 1 in which said alkylated hydroxytoluene is 2,6-di-t-butyl-p-cresol.

8. A lubricating oil composition for a two-cycle engine comprising a major proportion of a hydrocarbon lubricating oil and a minor amount of the additive of claim 1.

9. The lubricating oil composition of claim 8 which comprises from about 55 to about 65% by volume of a neutral oil, from about 7 to about 12% by volume of a bright stock, from about 12 to about 20% by volume of an organic solvent, and from about 7 to about 20% by volume of an admixture of a major amount of the salt of two equivalents of an N-dialkylaminoalkane with one equivalent of a dimer dicarboxylic acid and one equivalent of an alkyl acid phosphate and a minor amount of an alkylated hydroxytoluene.

* * * * *